United States Patent [19]

Kirkhuff et al.

[11] 4,095,140

[45] June 13, 1978

[54] TRIGGER CIRCUIT FOR FLASH LAMP DIRECTLY COUPLED TO AC SOURCE

[75] Inventors: Ellison H. Kirkhuff, Needham; James C. Morris, Wakefield, both of Mass.

[73] Assignee: GTE Sylvania Incorporated, Stamford, Conn.

[21] Appl. No.: 775,122

[22] Filed: Mar. 7, 1977

[51] Int. Cl.[2] ..... H05B 41/16; H05B 41/30

[52] U.S. Cl. ..... 315/199; 315/194; 315/208; 315/261; 315/335; 315/DIG. 7

[58] Field of Search ..... 315/194, 199, 208, 234, 315/235, 261, 335, DIG. 5, DIG. 7, 241 P

[56] References Cited

U.S. PATENT DOCUMENTS

| | | | |
|---|---|---|---|
| 3,116,671 | 1/1964 | Schankler | 315/241 P |
| 3,544,840 | 12/1970 | Saiger | 315/205 |
| 3,745,896 | 7/1973 | Sperti et al. | 315/241 P |
| 3,962,601 | 6/1976 | Wrzesinski | 315/241 P X |
| 4,041,351 | 8/1977 | Whitehouse et al. | 315/199 X |

*Primary Examiner*—Eugene R. LaRoche
*Attorney, Agent, or Firm*—Edward J. Coleman

[57] ABSTRACT

A circuit arrangement for triggering an arc discharge flash lamp that is directly coupled through series circuitry across an alternating current (AC) source. The lamp is ignited by a high voltage pulse generated from a pulse transformer in response to discharge of a voltage doubler charging capacitor by a controlled switch trigger from an RC timing circuit at a predetermined phase of the alternating current power source. Circuit operation is initiated by a switching arrangement which is coupled to the timing circuit through a zero crossing detector and shunt switch for assuring that the timing circuit starts at a predetermined point on the alternating current waveform. In this manner, the lamp reliably flashes with the same intensity each time a flash is requested.

14 Claims, 1 Drawing Figure

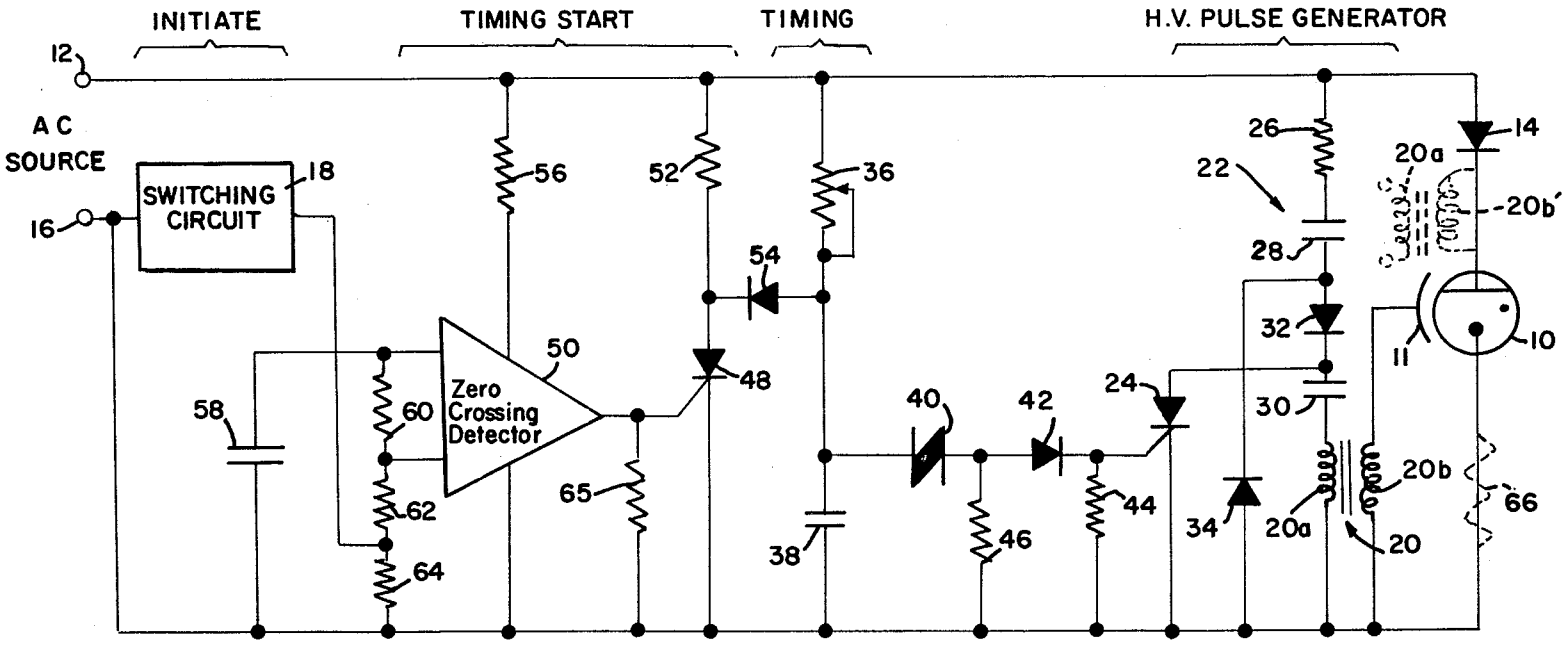
H.V. PULSE GENERATOR
TIMING
TIMING START
INITIATE
A C SOURCE
SWITCHING CIRCUIT
Zero Crossing Detector
10
11
12
14
16
18
20
20a
20b
20b'
22
24
26
28
30
32
34
36
38
40
42
44
46
48
50
52
54
56
58
60
62
64
65
66

TRIGGER CIRCUIT FOR FLASH LAMP DIRECTLY COUPLED TO AC SOURCE

BACKGROUND OF THE INVENTION

This invention relates generally to electrical circuits for operating arc discharge flash lamps and, more particularly, to an improved circuit arrangement for triggering a flash lamp which is directly coupled to an alternating current (AC) source.

Flash lamps of the type referred to herein generally comprise two spaced apart electrodes within an hermetically sealed glass envelope having a rare gas fill, typically xenon, at a subatmospheric pressure. In typical prior art operating circuits, such lamps are connected across a large energy storage device, such as a bank of capacitors, charged to a substantial potential, but insufficient to ionize the xenon gas fill. Upon application of an additional pulse of sufficient voltage, the xenon is ionized and an electric arc is formed between the two electrodes, discharging the storage device through the flash lamp, which emits a burst of intense light. In many cases the pulse voltage is applied between an external trigger electrode, such as a wire wrapped around the envelope, and one of the electrodes; this is referred to as shunt triggering. However, in other cases an external wire is not feasible since it may result in an undesirable arcing between the trigger wire and a proximate lamp reflector, or else the high potential applied to the external trigger wire might be hazardous to operating personnel. In those cases, the lamp may be internally triggered by applying the pulse voltage directly across the lamp electrodes, a technique referred to as injection triggering. Usually the voltage required is about 30 to 50 percent higher than that required to trigger the same lamp with an external trigger wire, and the trigger transformer secondary must carry the full lamp current.

Such flash lamps are employed in a variety of applications; for example, flash photography; reprographic machines; laser excitation; and warning flashers on airplanes, towers, road barriers, marine equipment and tower mounted approach lighting systems for airport runways. Typical prior art power supplies pose serious disadvantages for a number of these applications, however, as the required energy storage devices, such as large banks of capacitors, tend to be bulky, heavy and expensive, as are required step-up transformers. This is particularly apparent in endeavors to provide compact, low cost photographic flash lamps, or light weight runway flashers for mounting on frangible towers. Accordingly, it is particularly desirable to find a means for eliminating the large energy storage devices in flash lamp power supplies. In pursuit of this end, it has been observed that much higher than average short duration currents are routinely drawn from AC power lines; for example, compressor motor starting transients (locked rotor currents) are four to seven times their running currents. Metal fuses, another example, can handle peak half cycle currents 10 or more times their continuous ratings. Hence, in order to overcome the aforementioned disadvantages, it has been proposed to take advantage of this high transient current capacity of conventional 120 volt, 60 Hertz AC power sources to draw controlled pulses of high current to operate flash lamps. Three U.S. patents that describe the direct coupling of flash lamps to an AC source are U.S. Pat. Nos. 3,497,768 Mathisen, 3,745,896 Sperti et al (FIGS. 20–25 and col. 14 on), and 3,896,396 Whitehouse et al. In Mathisen, a silicon controlled rectifier (SCR) is connected in series with a xenon flash lamp across the secondary winding of a step-up transformer, the primary of which is connected to a conventional 60 Hertz, 120 volt AC source. A storage capacitor normally charged from the AC source is coupled via a pulse transformer to the trigger electrode on the lamp. When the lamp is to be energized, a switch operated trigger circuit places the SCR in a conductive state to connect the lamp directly across the AC source (transformer secondary) during a properly poled half cycle of the input voltage, and the storage capacitor also discharges through the SCR and pulse transformer winding to apply a high voltage starting pulse to the trigger electrode of the lamp. In this manner, the Mathisen lamp is energized for approximately one-half cycle of the AC waveform to provide a short duration, high intensity source of radiation.

In Sperti et al, a flash lamp is connected directly across a conventional AC source through a series resistor which provides overcurrent protection. The trigger circuit of FIG. 20 includes a half-wave rectifier connected across the AC source, a pair of storage capacitors, and an interrupter, such as a magnetic reed switch, which is connected to the trigger electrode of the lamp. In operation, one of the capacitors is charged by the AC source, then, when a trigger switch is closed, the charge is transferred to the second capacitor to provide a source of DC to the interrupter. This DC is transformed by the interrupter into a pulsating high voltage current which is applied to the trigger electrode to ionize the lamp. The interrupting frequency is about 300 Hertz, and flash duration, which is dependent upon the dissipation of the charge on the second capacitor, may extend over more than one half of a power cycle. In the variation of FIG. 21 of Sperti et al, there is no second storage capacitor, and closure of the trigger switch turns on an SCR through which the interrupter is energized by the charge on the initial storage capacitor. The variation of FIG. 22 of Sperti et al, employs a capacitor discharge to turn on the SCR. In FIG. 23 of Sperti et al, closure of the trigger switch provides a measured power pulse from a capacitor which momentarily energizes a relay which actuates a switch for connecting the AC source across the primary of a transformer having a 2000 volt output. A spark gap is connected across the secondary of this transformer, and connected in parallel with the spark gap is a storage capacitor in series with the primary of a radio frequency transformer having a secondary connected to the trigger electrode on the lamp. Hence, when the AC source is connected to the 2000 volt transformer, the spark gap breaks down, thereby causing a short circuit across the transformer and discharging the storage capacitor through the arc. This, in turn, causes a large voltage to appear across the secondary of the radio frequency transformer, whereupon the lamp is triggered to flash. The 2000 volt transformer produces spark gap break down on both halves of the AC cycle; hence, a pulsating radio frequency trigger voltage is produced at 1/120 second intervals. FIG. 24 is similar to FIG. 23 except that closure of the trigger switch turns on an SCR which energizes the relay. FIG. 25 is similar to FIG. 24, except that a capacitor discharge is employed to turn on the SCR.

In Whitehouse et al, a flash lamp is connected directly across an AC source through a series diode. One embodiment shows a flash lamp being excited from two phases of a three-phase Y-connected AC source so as to permit lengthening of the flash lamp pulses over that possible with a single phase system. FIG. 3 of Whitehouse et al employs a pair of capacitors across the lamp in connection with a capacitor charger to add to the current surge through the lamp during initial firing. The charger is described as including a transformer energized by a third phase of the AC source and a rectifying diode. The trigger circuitry is shown in FIG. 4 of the patent and includes a logic circuit which senses the AC voltage across one phase of the source to produce a narrow pulse at the desired angle. The logic circuit comprises a full wave rectifier connected between the AC source and the input of a monostable multivibrator which produces an output pulse at the phase angle of each cycle selected by a firing angle adjustment (not described). The monostable pulses are coupled to both a digital counter and one input of an AND gate. The digital counter functions to count out the desired number of pulses firing the flash lamp with each pulse, then counts out a pause between bursts of pulses. The number of pulses in a burst of pulses from the counter is set by external switches. The counter produces a binary 0 state when the desired number of pulses has been counted and applies this signal to a second input of the AND gate. The burst of pulses (e.g. three 60 Hertz pulses) at the output of the AND gate is coupled through a first pulse transformer to trigger an SCR into conduction. The SCR is connected in the primary circuit of a second pulse transformer coupled to the trigger electrode of the flash lamp. This primary circuit also includes a capacitor and a resistor connected to a +200 volt DC supply. When the SCR is switched on, this capacitor is coupled across the primary winding of the second transformer, and current through the loop will be a half sine wave pulse. This results since the capacitor and transformer inductance form a resonant circuit, and the current cannot reverse through the SCR. The pulse is then coupled through the second transformer to ignite the lamp. In a specific embodiment, three pulses are counted out each burst to flash the lamp three times; then after counting out a pause, the same burst of three pulses will be repeated.

Although avoiding the need for large storage capacitors, direct-line-coupled flash lamp circuits can exhibit their own peculiar problem areas. For example, due to the rather arbitrary relationship between the time of initiating switch activation and the phase of the AC source waveform, it is possible to have significant variations in light intensity from one flash to another. In fact, lack of precise synchronization may result in occasional failure of the lamp to flash when requested.

SUMMARY OF THE INVENTION

Accordingly, it is an object of the present invention to provide an improved power supply for operating arc discharge flash lamps.

It is a particular object to provide an improved trigger circuit for operating a flash lamp directly coupled to an AC source.

Another object is to provide means for reliably triggering a flash lamp directly coupled to an AC source, with the intensity of each flash being constant.

These and other objects, advantages and features are attained, in accordance with the principles of the present invention, by a trigger circuit arrangement comprising a high voltage pulse generating means coupled to the lamp, a timing circuit connected to the pulse generating means for controlling the time of pulsed ignition of the lamp with respect to the phase of the AC source waveform, an initiating means, and a circuit responsive thereto for starting the timing circuit at a predetermined point on the AC waveform. In one embodiment, the high voltage pulse generator comprises a voltage doubler, SCR, and pulse transformer. An RC timing circuit provides a trigger for the SCR through a voltage breakdown diode. The initiating means typically comprises a switching circuit, and the starting circuit is interposed between the initiating switch and the RC timing circuit to assure that the RC circuit will begin charge at the same point on the AC waveform regardless of when the initiating switch is actuated. In this manner, the SCR in the pulse generator fires at a constant selected time on the AC waveform, thereby providing reliable triggering of the lamp with flash intensity remaining constant.

BRIEF DESCRIPTION OF THE DRAWING

This invention will be more fully described hereinafter in conjunction with the accompanying drawing, the single FIGURE of which is a schematic diagram of a circuit for operating a flash lamp directly from an AC source and including a trigger circuit in accordance with the invention.

DESCRIPTION OF PREFERRED EMBODIMENT

Referring to the drawing, the anode of the arc discharge flash lamp 10, which is preferably a xenon flash lamp, is coupled to one terminal 12 of the AC power source through a series connected diode 14. The AC source may be a conventional 120 volt, 60 Hertz power line. The cathode of the lamp 10 is coupled directly to the other AC terminal 16, which is the neutral line. With this connection, the flash lamp 10, once ignited, will emit light and conduct only during the positive half cycles of the single phase AC power source 12, 16. Diode 14 assures turn off of the lamp 10 during negative half cycles.

Lamp 10 is triggered by a high voltage pulse generator controlled by a timing circuit in response to actuation of an "initiate" circuit. The "initiate" function is accomplished by a switching circuit 18, which may comprise a mechanical switch, a manually controlled electronic switch, or a periodic timer. In accordance with the present invention, the trigger circuitry further includes a "timing start" section which functions to start the timing circuit at the exact same point on the incoming waveform each time it is requested to do so by the "initiate" switching circuit, thereby operating the trigger to ignite the flash lamp at the same point of each requested waveform. In this manner, the "timing start" function operates to assure that the lamp flashes each time with repeatable intensity, regardless of the phase relationship of the "initiate" switch actuation with respect to the requested waveform. Again, diode 14 is in the circuit to assure that the lamp turns off when the voltage waveform of the AC source goes negative.

The high voltage pulse generator comprises a pulse transformer 20, a voltage doubler 22 and a controlled switching means 24, such as a silicon controlled rectifier (SCR). The voltage doubler consists of resistor 26, capacitors 28 and 30, and diodes 32 and 34. Components 26, 28, 32 and 30 are series connected in that order with the primary winding **20*a* of the pulse transformer across the AC source 12, 16. Diode 34 is connected, as shown, between AC terminal 16 and the junction of components 28 and 32**.

The secondary winding **20*b* of the pulse transformer is connected between the cathode of lamp 10 and an external trigger electrode 11 mounted in close proximity to the flash lamp 10 for capacitively coupling pulsed high voltage to the lamp. Hence, the lamp is adapted to be shunt triggered. Alternatively, if it is desired to employ injection triggering of the lamp, the secondary winding of pulse transformer 20 would be connected in series with the flash lamp 10, as illustrated in the drawing by the dashed line representation labeled 20***b'*.

Capacitor 28 of the voltage doubler typically is from about one-tenth to one-fifteenth the value of capacitor 30. For example, in one specific embodiment operating from a 120 volt, 60 Hertz source, capacitor 30 is 0.15 microfarad, and capacitor 28 is 0.01 microfarad. Accordingly, capacitor 30 will charge to about 300 volts DC after approximately five completed cycles of a 60 Hertz, 120 volt input; this is about 80 milliseconds. SCR 24 is connected across capacitor 30 and primary winding 20*a*, with the anode connected to the junction of components 32 and 30 and the cathode connected to AC terminal 16. Hence, when SCR 24 is triggered into conduction, the 300 volts on capacitor 30 is discharged across primary winding 20*a*. As a result, a pulse of 4000 volts or greater is applied to the trigger electrode of the flash lamp from the secondary of pulse transformer 20. In the specific embodiment, a transformer with a turns ratio of about 1:10 is employed which provides a 10,000 volt pulse. This pulsing ionizes the xenon fill gas, and if the anode to cathode voltage is sufficient to sustain ionization, the lamp will conduct heavily until the AC voltage drops below the lamp deionization voltage. Diode 14 then stops current flow when the high side of the line (terminal 12) goes negative.

For maximum intensity, the lamp should be ionized when the anode to cathod voltage is at or very near the peak of the AC waveform. The current peak depends upon the impedances of the line (terminals 12 and 16) and the lamp acting in series. To control the time of pulsed ignition of the lamp with respect to the phase of the AC source waveform, an RC timing circuit is provided which comprises an adjustable resistor 36 and a charging capacitor 38 series connected across AC terminals 12 and 16. When timing capacitor 38 charges to a predetermined level, a trigger pulse is applied to the gate, or control terminal, of SCR 24 through a coupling circuit comprising a voltage breakdown diode 40, such as a diac or a semiconductor unilateral switch (SUS), and an isolating diode 42. The value of resistor 36 is adjusted to fire SCR 24 near the positive peak of the AC waveform. In the aforementioned specific embodiment, capacitor 38 is selected to have a value of 0.022 microfarads, and resistor 36 has a value of 200 K ohms to fire the lamp at or slightly before the peak. Diode 40 is a 30 volt diac so that when capacitor 38 charges to 30 volts, diode 40 breaks down and discharges into the gate of SCR 24 through diode 42, which isolates the SCR gate from negative charges. The coupling circuit further includes two resistors connected in parallel with capacitor 38 to assure resistive damping of the gate circuit of SCR 24 and to discharge capacitor 38 when it charges negatively with respect to the gate. More specifically, a 1000 ohm resistor 44 is connected between the SCR gate and AC terminal 16, and a 220 ohm resistor 46 is connected between the junction of diodes 40, 42 and terminal 16. This arrangement gives capacitor 38 a starting point on each positive half cycle charge.

If a normally closed switch were connected across timing capacitor 38, the capacitor could not charge and the SCR could not discharge capacitor 30. In such a case, capacitor 30 would charge to its full 300 volts DC. Opening the switch would allow timing capacitor 38 to charge, whereupon diode 40 would fire, thereby causing SCR 24 to conduct and discharge capacitor 30 across pulse transformer 20 to fire lamp 10. If the switch were left open, the SCR would conduct again on the next positive half cycle, but in that time interval, capacitor 30 would only have charged to the energy contained in capacitor 28, about 50 to 75 volts. The resulting pulse applied to the trigger electrode of the lamp would then be only about 800 volts, which is insufficient to flash the lamp. Accordingly, the aforementioned hypothetical switch across timing capacitor 38 must be opened and closed in a manner allowing capacitor 30 to reach the full charge necessary to enable firing the lamp.

In order to obtain the same intensity during each flash lamp 10 must be ionized at the same point on the same AC waveform each time it is triggered. Hence, the "switch" across timing capacitor 38 must be opened at precisely the same time, with respect to this waveform, each time a flash is requested by the "initiate" circuit. In accordance with the present invention, this task is accomplished by the "timing start" circuit, which comprises a controlled switch 48, such as an SCR or triac, coupled across timing capacitor 38 and a zero crossing detector 50 having a pulse output connected to the gate, or control terminal, of SCR 48. The SCR is also connected across the AC source terminals 12 and 16 in series with a resistor 52, which functions to limit the current through the SCR 48. In the specific embodiment, resistor 52 is a 10 K ohm, 2 watt device. The junction of RC components 36, 38 is coupled to the junction of SCR 48 and resistor 52 through diode 54. When SCR 48 is conducting, capacitor 38 cannot charge; hence, SCR 48 is turned off to start the charge cycle of the RC timing circuit. Diode 54 isolates resistor 52 from resistor 36 during the charge time of capacitor 38.

A number of integrated circuit (IC) units are available for use as zero crossing detector 50. The aforementioned specific embodiment employed an RCA zero-voltage switch type CA3059. In this specific case. leads 7 and 8 (not shown) of the IC unit are tied together and connected to AC terminal 16. Resistor 56, having a value of 8.2 K ohms, is series connected between lead 5 (not shown) of the IC unit and AC terminal 12 to power the zero crossing detector. Leads 2 and 3 (not shown) of the IC unit are tied together and coupled through a 100 microfarad, 16 volt DC capacitor 58 to AC terminal 16; this capacitor acts as a filter for the 8 volts DC of the IC unit. Lead 4 (not shown) of the IC unit is connected to the gate of SCR 48, and resistors 60, 62 and 64 are connected in series across capacitor 58, with the junction of resistors 60 and 62 being connected to lead 9 (not shown) of the IC unit. In the specific embodiment, resistors 60, 62 and 64 have values of 10 K ohms, 4.7 K ohms and 18 K ohms respectively. A resistor 65, which has a value of 5.1 K ohms is connected between the gate of SCR 48 and aC terminal 16. A switching function is provided across resistor 64 by the "initiate" switching circuit 18 which is shown connected between AC terminal 16 and the junction of resistors 62 and 64. Leads 10, 11 and 13 (not shown) of the IC unit are tied together to provide a one-to-one differential amplifier so that when resistor 64 is shorted out, the ratio of resistors 60 and 62 allows the IC unit to generate a 1.5 volt pulse every time the AC waveform crosses zero. This keeps the SCR 48 conducting, whereupon capacitor 38 is prevented from charging. When the switching circuit across resistor 64 is opened, zero crossing detector 50 is turned off. As a result, SCR 48 is also turned off when the waveform therethrough crosses zero; capacitor 38 then starts charging and the flash lamp triggering cycle occurs. With this circuit, capacitor 38 will begin charge at the same point, zero, regardless of when switching circuit 18 is opened. Accordingly, SCR 24 fires at a constant selected time, and the flash intensity remains constant.

Flash intensity can be changed by appropriate selection of the point on the AC waveform where flashing is to occur or by resistive ballasting of the flash lamp 10, such as by adding a resistor 66 in series with the lamp (as illustrated in dashed lines) and thereby limiting the current through the lamp.

Continuous flashing on every cycle can be provided by increasing the capacitance of capacitor 28 so that capacitor 30 can charge faster and increase the trigger pulse to that required to ionize the lamp. With such a circuit arrangement, a pulse width switch as circuit 18 could provide continuous flashing at repetitive counts, so called "dithering".

Although the described circuit can be made using component values in ranges suitable for each particular applicaton, as is well known in the art, the following table lists component values and types for one flash lamp operating circuit made in accordance with the present invention:

| | |
|---|---|
| Diode 14 | IN4724 |
| Capacitor 30 | 0.15 microfarad, 600 volts |
| Diodes 32,34,42 and 54 | IN4004 |
| Capacitor 28 | 0.01 microfarad, 200 volts |
| Resistor 26 | 2400 ohms, 1 watt |
| SCR 24 | 2N4444 |
| Resistor 44 | 1000 ohms |
| Resistor 46 | 220 ohms |
| Diode 40 | ST-2 |
| Resistor 36 | 200 K ohms |
| Capacitor 38 | 0.022 microfarad, 400 volts |
| Resistor 52 | 10 K ohms, 2 watts |
| SCR 48 | 2N5064 |
| Resistor 56 | 8200 ohms, 3 watts |
| Resistor 60 | 10 K ohms |
| Resistor 62 | 4700 ohms |
| Resistor 64 | 18 K ohms |
| Capacitor 58 | 100 microfarads, 16 volts |
| Resistor 65 | 5100 ohms |
| Transformer 20 | 1:30 turns ratio |

Although the invention has been described with respect to specific embodiments, it will be appreciated that modifications and changes may be made by those skilled in the art without departing from the true spirit and scope of the invention. For example, in lieu of using diode 14 to turn off the lamp, resistor 66 could be made sufficiently large to reduce power so as to eliminate false firing. Also deionizing agents, such as hydrogen, could be added to the gas fill of lamp 10 to prevent false firing.

What we claim is:

1. In an electrical circuit for operating an arc discharge flash lamp which is directly coupled through series circuit means across a source of alternating current, a circuit arrangement for triggering said lamp comprising:

high voltage pulse generating means connected to said alternating current source to be energized thereby and coupled to said flash lamp for applying pulsed high voltage to ignite the lamp;

a timing circuit connected to said alternating current source to be energized thereby and coupled to said pulse generating means for controlling the time of pulsed ignition of said lamp with respect to the phase of the alternating current waveform of said source;

means for initiating operation of said circuit arrangement for triggering said lamp; and circuit means responsive to said initiating means for starting said timing circuit at a predetermined point on said alternating current waveform.

2. The triggering circuit arrangement of claim 1 wherein said series circuit means comprises a diode connected in series with said lamp for assuring that said lamp, when ignited during a half cycle of predetermined polarity of the alternating current waveform of said source, is turned off when said waveform goes to the opposite polarity.

3. The triggering circuit arrangement of claim 1 wherein said series circuit means comprises a resistor connected in series with said lamp for reducing the intensity of the light output of said lamp, when ignited, by limiting the current therethrough.

4. The triggering arrangement of claim 1 wherein said timing circuit is an RC charging circuit, said starting circuit comprises a first controlled switching means coupled across a portion of said charging circuit and a zero crossing detector connected to be energized by said alternating current source and to control said first switching means, and said initiating means comprises a second switching means connected to control the operation of said zero crossing detector.

5. The triggering circuit arrangement of claim 1 wherein said high voltage pulse generating means comprises a pulse transformer having a secondary winding coupled to said flash lamp and a primary winding, a first capacitor charging means series connected with said primary winding to be energized by said alternating current source, and a first controlled switching means connected in circuit with said first capacitor charging means and said primary winding and having a control terminal coupled to said timing circuit, said first switching means being operative, when triggered by said timing circuit, to discharge said first capacitor charging means through the primary winding of said pulse transformer.

6. The triggering circuit arrangement of claim 5 wherein said timing circuit includes a first resistor and a second capacitor charging means series connected to be energized by said alternating current source, the junction of said first resisitor and second capacitor charging means being connected to the control terminal of said first switching means through a first coupling means and to said starting circuit by a second coupling means, and the value of said first resistor being selected to trigger said first switching means near a predetermined point on said alternating current waveform.

7. The triggering circuit arrangement of claim 6 wherein said starting circuit comprises a second controlled switching means having first and second terminals connected through circuit means across said alternating current source, and having a control terminal, and a zero crossing detector connected to be energized by said alternating current source and having a pulse output connected to the control terminal of said second switching means, said second coupling means being connected between the resistor-capacitor junction of said timing circuit and the first terminal of said second switching means, whereby said second switching means is coupled across said second capacitor charging means so that conduction of the second switching means prevents charging of the second capacitor means,.

8. The triggering circuit arrangement of claim 7 further including an external trigger electrode mounted in close proximity to said flash lamp for capacitively coupling pulsed high voltage to the lamp, the secondary winding of said pulse transformer being connected to said trigger electrode, whereby said lamp is adapted to be shunt triggered.

9. The triggering circuit arrangement of claim 7 wherein said secondary winding is connected in series with said flash lamp, whereby said lamp is adapted to be injection triggered.

10. The triggering circuit arrangement of claim 7 wherein a second resistor is connected between the first terminal of said second switching means and said alternating current source for limiting the current therethrough, and said second coupling means comprises a diode for isolating said second resistor from said first resistor during charging of said second capacitor means.

11. The triggering circuit arrangement of claim 7 wherein said first coupling means includes a voltage breakdown diode series connected between the resistor-capacitor junction of said timing circuit and the control terminal of said first switching means, said breakdown diode being selected to discharge said second capacitor means to trigger the control terminal of said first switching means when said second capacitor means charges to a predetermined voltage.

12. The triggering circuit arrangement of claim 11 wherein said first coupling means further includes a diode connected in series between the control terminal of said first switching means and said breakdown diode for isolating said first switching means from charges of a predetermined polarity on said second capacitor means, and resistor means connected in parallel with said second capacitor means for damping the circuit of said first coupling means and discharging said second capacitor means when it builds up charges of said predetermined polarity.

13. The triggering circuit arrangement of claim 7 wherein said high voltage pulse generating means further includes a voltage doubler circuit connected to be energized by said alternating current source and containing said first capacitor charging means.

14. The triggering circuit arrangement of claim 13 wherein said initiating means comprises a third switching means connected to control the operation of said zero crossing detector.

* * * * *